US005131421A

United States Patent [19]

Hofbauer

[11] Patent Number: 5,131,421

[45] Date of Patent: Jul. 21, 1992

[54] ADAPTOR FOR FLUSHING OR COOLING STERN DRIVE ENGINES

[76] Inventor: Arthur M. Hofbauer, 2931 Whaleneck Dr., Merrick, N.Y. 11566

[21] Appl. No.: 764,038

[22] Filed: Sep. 23, 1991

[51] Int. Cl.[5] ..... B08B 3/02

[52] U.S. Cl. ..... 134/166 R; 134/169 A; 134/201; 134/198; 440/900; 440/113

[58] Field of Search ..... 134/169 A, 167 R, 166 R, 134/201, 198; 440/88, 900, 113, 87

[56] References Cited

U.S. PATENT DOCUMENTS

| | | | |
|---|---|---|---|
| 2,644,440 | 7/1953 | Bailey, Sr. | 134/166 R X |
| 2,644,474 | 7/1953 | Houchin | 134/167 R |
| 2,839,068 | 6/1958 | Cassia | 134/166 R X |
| 3,034,521 | 5/1962 | Greenfield | 134/166 R X |
| 3,134,388 | 5/1964 | Peloso | 134/166 R |
| 3,431,145 | 3/1969 | Riley | 134/166 R X |
| 4,108,190 | 8/1978 | Carlson | 134/167 R |
| 4,121,948 | 10/1978 | Guhlin | 134/167 R X |
| 4,209,063 | 6/1980 | Babish | 134/169 A X |
| 4,540,009 | 9/1985 | Karls | 134/167 R |
| 4,589,851 | 5/1986 | Karls | 440/88 |
| 4,729,393 | 3/1988 | Ferguson | 134/167 R |
| 4,842,002 | 6/1989 | Ferguson | 134/167 R |
| 4,949,765 | 8/1990 | Creeron | 134/169 A X |
| 4,972,863 | 11/1990 | Morrow | 134/166 R |
| 4,973,276 | 11/1990 | Mavrelis | 440/113 |

*Primary Examiner*—Frankie L. Stinson
*Attorney, Agent, or Firm*—Pennie & Edmonds

[57] ABSTRACT

An adaptor directs water into the engine of a stern drive boat which has the outdrive removed therefrom. The adaptor comprises a support plate having a first side, a second side, and at least one aperture extending therethrough. A body member has a central bore and a first end portion connected to the support plate. The central bore of the body member is in alignment with the aperture, which is in alignment with a cooling orifice of the engine. The adaptor further comprises a connector for attaching a fluid conduit such as a hose to the body member at a second end portion and a spacer to assist in the connection of the support plate to the gimbal housing. Water which passes through the fluid conduit also passes through the central bore of the body member, the support plate aperture, the cooling orifice and into the engine for cooling or flushing thereof.

20 Claims, 4 Drawing Sheets

ADAPTOR FOR FLUSHING OR COOLING STERN DRIVE ENGINES

BACKGROUND OF THE INVENTION

1. Field of the Invention

The present invention relates to motor boats and, in particular, to an adaptor that allows for the cooling or flushing of motor boat engines when the boat is out of the water.

2. Description of the Prior Art

Stern drive engines, also known as inboard/outboard engines, are commonly used in motor boats as a source of power to propel the boats through a river, lake, or the ocean. These boats commonly draw cooling water into the engine through an outdrive to maintain the engines within an acceptable operating temperature range. Thus, so long as the boat remains in the water, the engine may be operated for extended periods of time without overheating.

When work such as repairs, tune-ups, flushing or winterizing must be performed on the engine, it is usually desirable to remove the boat from the water and perform this work on land. This work often requires that the engine be running, however, and, since the boat is out of the water, there is no longer any source of water to cool the engine. Thus, the engine could be permanently damaged if these repairs are attempted.

The prior art provides several different device to flush outboard and/or stern drive engines while the boat is out of the water, and these methods and apparatuses could also be used to cool the engines while they are running. See, for example, U.S. Pat. Nos. 4,108,190 to Carlson; 4,540,009 to Karls; 4,589,851 to Karls; 4,729,393 to Ferguson; 4,842,002 to Ferguson; and 4,973,276 to Mavrelis. Each of these devices requires that the outdrive remain connected to the boat.

However, the work described above very often requires that the outdrive be removed from the boat for safety reasons or to allow the mechanic to do the work. Further, since this work tends to be done at the beginning or end of a boating season, many different boats will be out of the water at the same time awaiting their turn to worked on. Since the outdrives on boats sitting in a boatyard are very susceptible to theft because they are easily removable from the gimbal housing, they are usually removed and placed in storage until the boat is read to go back into the water. Thus, since the above-referenced patent methods and apparatuses require the outdrive to be in place, they are useless to cool or flush an engine when the outdrive is removed.

In response, boat mechanics solved this problem by cutting off the end of a garden hose, inserting the hose into a cooling orifice in the gimbal housing leading to the engine, and turning on the water while the engine was running. However, this method is deficient and does not adequately insure that the engine will receive an adequate supply of water while the engine is running, since there is no way to insure that the hose will not become disconnected from the orifice. The hose is merely wedged into the orifice, so that the water pressure often pushes the hose out of the orifice, or people walking by the boat accidentally trip on the hose and kick or pull it out of the orifice. Thus, the mechanic must constantly get in and out of the boat to replace the hose. Further, the mechanic must constantly check to make sure the hose did not fall out while he is working on the engine. Thus, the mechanic is distracted from the task at hand, and it takes him longer to work on the engine.

Further, the engine must often be kept running for an extended period of time either before or after it has been worked on to either uncover the source of a problem or make sure the work was done properly. Thus, since the mechanic cannot be sure that the hose will remain in the orifice, he is forced to remain close to the boat to make sure that the hose does not become disconnected. This wastes a great deal of the mechanic's time and prevents him from working on other engines.

Finally, the seal between the hose and orifice is often inadequate, thereby allowing a great deal of water to spray out from the orifice and wet the entire work area. This makes it more difficult and inconvenient to work on the boat.

Accordingly, there is a need for a more secure connection between a hose or other fluid conduit and an engine so that water may be more reliably supplied to cool or flush the engine, that will prevent or minimize spraying and that will allow the engine to be left running unattended for an extended period of time.

SUMMARY OF THE INVENTION

In accordance with the present invention there is provided an adaptor for directing water into a stern drive engine through the gimbal housing after the outdrive has been removed therefrom. The adaptor comprises a support plate having a first side, a second side, and at least one aperture extending therethrough. A body member having a central bore and first and second end portions is also provided. The first end portion of the body member is connected to one side of the support plate so that the central bore of the body member is in fluid communication with the aperture.

The adaptor further comprises means for connecting a fluid conduit to the body member at the second end portion, and means to facilitate connection of the support plate to the gimbal housing. The latter connection allows the aperture to be in fluid communication with a cooling orifice of the gimbal housing. Thus, water which passes through the fluid conduit also passes through the body member central bore, the support plate aperture the cooling orifice and into the engine for cooling or flushing thereof.

Also, a spacer may be provided in combination with a second aperture in the plate to facilitate connection of the adaptor to the engine. The spacer and second aperture allow passage of a gimbal housing stud therethrough so that the adaptor may be secured to the engine by tightening a nut onto the stud, thus retaining the spacer and adaptor in the desired position.

DETAILED DESCRIPTION OF THE PREFERRED EMBODIMENTS

Figure 1:
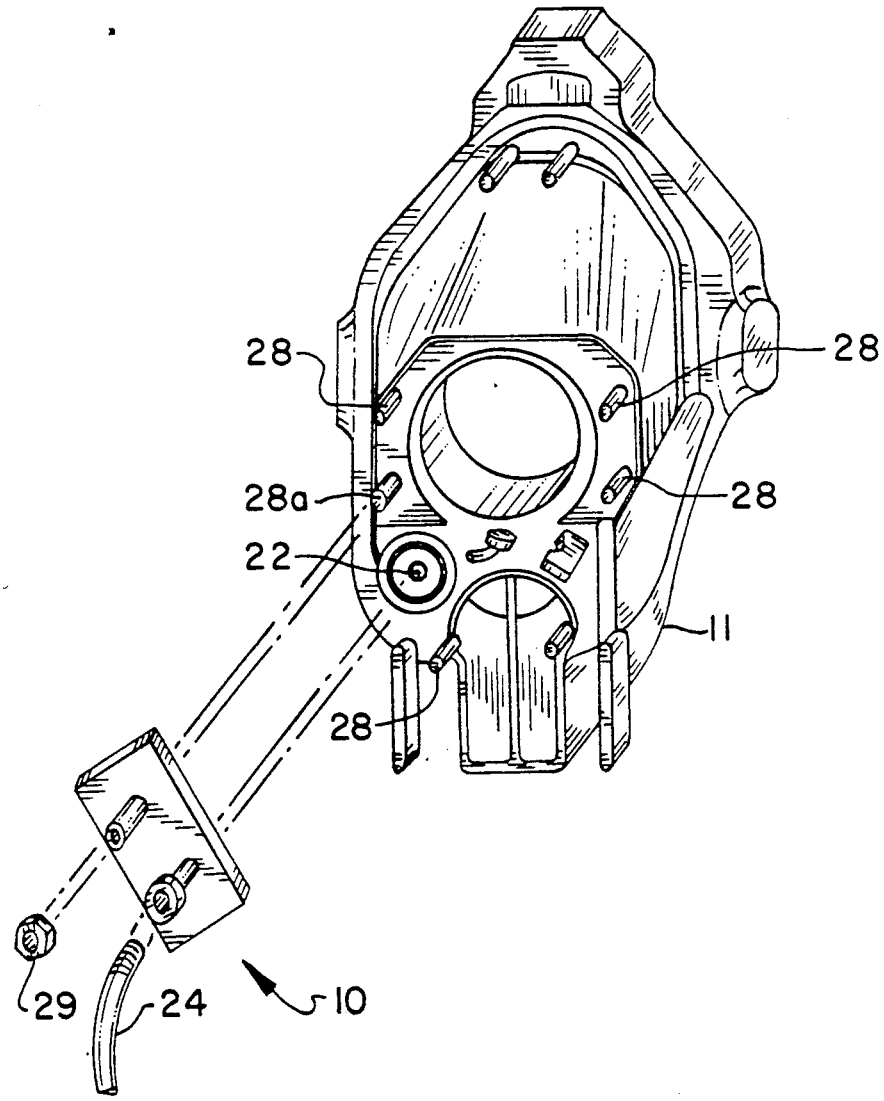
FIG. 1 is an exploded perspective view of a gimbal housing and one adaptor according to the present invention.
Figure 2:
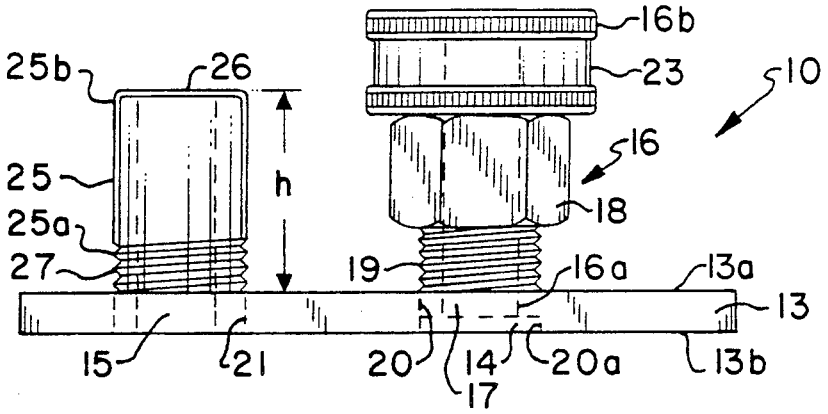
FIG. 2 is a side elevation view of another adaptor of the present invention for use with a Mercruiser Alpha drive unit.
Figure 3:
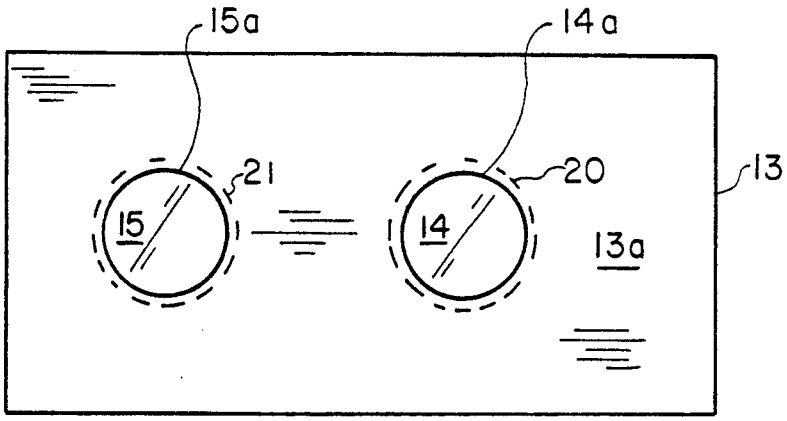
FIG. 3 is a plan view of the adaptor of FIG. 2.

Referring to the drawings and particularly to FIGS. 1, 2, and 3, there is illustrated a first embodiment of an adaptor generally designated by the numeral 10 for attaching a supply of water, such as a garden hose, to a gimbal housing 11 of a stern drive engine.

Adaptor 10 comprises a flat support plate 13 having a first side 13*a* and a second side 13*b*, and a first aperture 14 and a second aperture 15. In one arrangement, apertures 14, 15 have edges 14*a*, 15*a*, respectively, with threads 20, 21, respectively, therein. Threads 20 have a lower portion 20*a* and an upper portion 20*b*. The length and width of support plate 13, the distance between the centers of apertures 14, 15 and the size of apertures 14, 15 varies depending on the type of gimbal housing 11 to which adaptor 10 will be attached. For example, adaptor 10 shown in FIGS. 1, 2, and 3 is configured and dimensioned to be used with the gimbal housing of a Mercruiser Alpha drive unit. This invention contemplates other types of adaptors to be used with other types of gimbal housings, certain of which are disclosed below.

Adaptor 10 further comprises a body member 16 having a first portion 16*a*, a second portion 16*b* and a central bore 17 extending through body member 16. First portion 16*a* is attached to support plate 13 with central bore 17 in fluid communication with first aperture 14. Preferably, body member 16 comprises a threaded brass fitting having a hex-head 18 which allows the body member to be rotated by a wrench, and threads 19 which engage upper threads 20*b* in first aperture 14 and so that first portion 16*a* extends partially through aperture 14. A stop 20*a* can be designed into the aperture by providing threads only partially through the aperture. If desired, the body member portion 16*a* may extend into the aperture to be flush with side 13*b* of the support plate 13.

A device 23 for connecting a fluid conduit, such as a garden hose 24, is attached to second portion 16*b* of body member 16. Connecting device 23 is preferably a female garden hose connector and is preferably rotatably attached to second portion 16*b* to facilitate connection of the male end of a garden hose, which is connected to a source of water, such as a water dispensing spigot.

A spacer 25 having a first portion 25*a*, a second portion 25*b*, and a central bore 26 extending through spacer 25 is attached to support plate 13 with central bore 17 in alignment with second aperture 15. Preferably, spacer 25 comprises a brass fitting having threads 27 on first portion 25*a*, with threads 27 engaged with threads 21 in second aperture 15. However, it is also contemplated by the present invention that threads 21, 27 be omitted and that spacer 25 be attached to either first side 13*a* or edge 15*a* of second aperture 15 by welding, brazing, soldering or by a suitable adhesive such as an epoxy. Spacer 25 is provided to facilitate the connection of adaptor 10 to gimbal housing 11, as discussed below. However, it will become apparent that if desired, spacer 25 may be removed and apparatus 10 would still perform its intended function.

Figure 4:
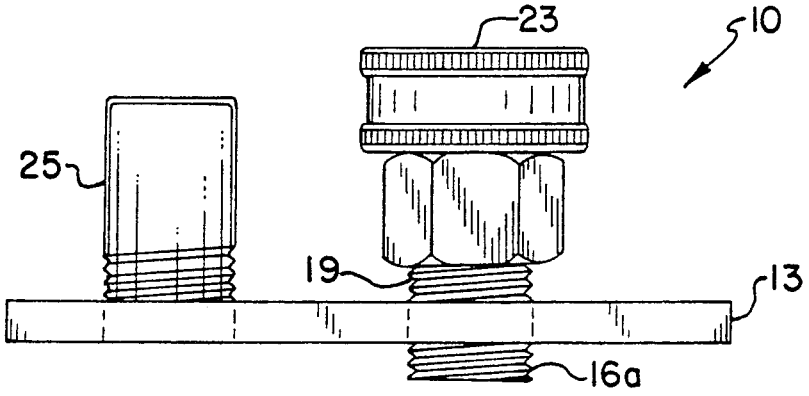
FIGS. 4–6 are side elevation views of modified versions of the adaptor of FIG. 2.
Figure 5:
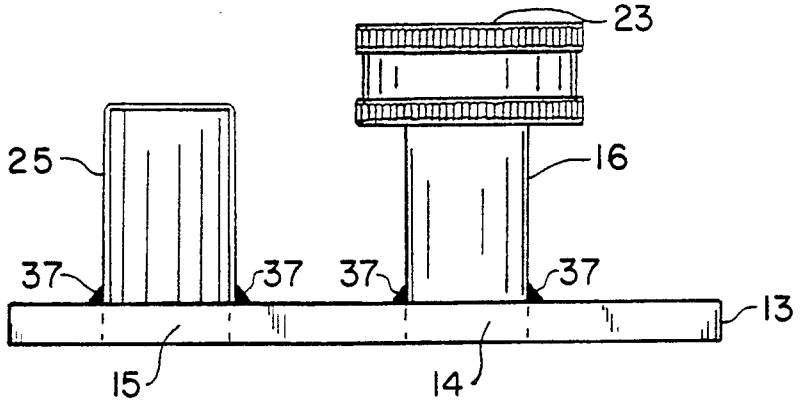
Figure 6:
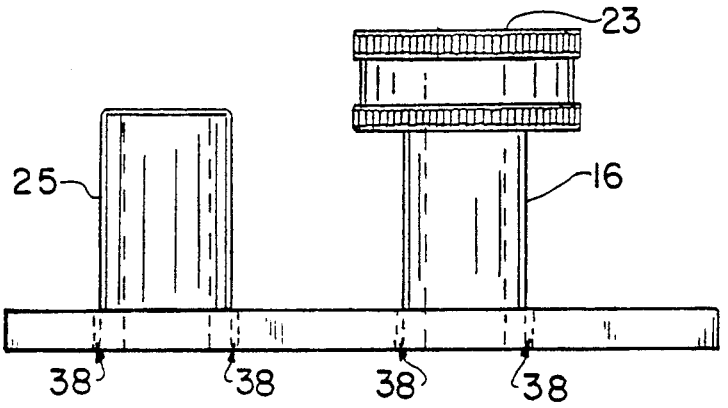

It is also contemplated by the present invention that first portion 16*a* may extend completely through first aperture 14, as shown in FIG. 4, to act as an alignment member so that body member 16 may be located and centered more easily in the water cooling orifice 22 of the gimbal housing. As shown in FIGS. 5 and 6, it is further contemplated that threads 19, 20 may be omitted and that body member 16 be attached to first aperture 14 by welding, brazing, soldering or by use of a suitable adhesive such as epoxy. In FIG. 5, spacer 25 and body portion 16 are placed upon support plate 13 over the apertures, and are secured in place by welds 37. In FIG. 6, spacer 25 and end portion 16 are dimensioned to have a smaller diameter then the support plate apertures 14, 15, so that they extend therethrough and leave a concentric space 38. In this embodiment, spacer 25 and end portion 16 are retained in the plate by use of an adhesive, such as an epoxy, which fills space 38. Also, braze metal or solder can be used to fill space 38 and join the parts to the plate. It is also possible to swage fit spacer 25 and end portion 16 into their respective apertures by configuring their outer diameters to be slightly greater than the aperture diameters and then press fitting the parts together to form a secure joint.

To use the adaptor 10 of the present invention, the outdrive of a stern drive engine is first removed from gimbal housing 11, thereby exposing studs 28 and cooling orifice 22. The stud 28*a* that is closet to cooling orifice 22 is then placed through second aperture 15 and spacer 25, while central bore 17 of body member 16 is aligned with cooling orifice 22. A nut 29 then tightened on stud 28*a* against spacer 25, thereby firmly securing second side 13*b* of support plate 13 flush against gimbal housing 11 and maintaining central bore 17 in alignment with cooling orifice 22.

Hose 24 is then connected to hose connector 23, and a flow of water is then activated. The water will flow through hose 24, body member 16, first aperture 14 and through the cooling orifice 22 to cool or flush the engine. Since hose 24 is secured to adaptor 10 which is, in turn, secured to gimbal housing 11, hose 24 will also be secured to gimbal housing 11. Thus, hose 24 cannot be dislodged from gimbal housing 11 and the engine can be left running unattended for an extended period of time without concern for loss of cooling water. Further, since plate 13 is firmly secured to gimbal housing 11, the amount of water leaking or spraying out of cooling orifice 22 is minimized. Thus, the work area will remain relatively dry.

Figure 7:
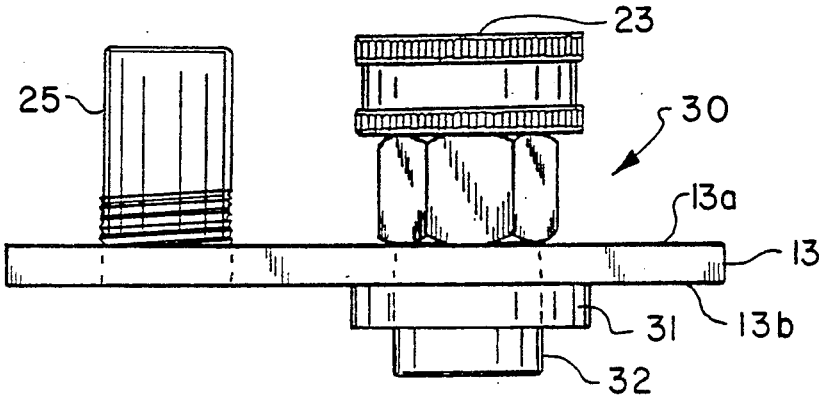
FIG. 7 is a side elevation view of another adaptor of the present invention for use with a Mercruiser Bravo drive unit.

Further embodiments of the present invention are shown in FIGS. 7–10. The parts of the adaptors shown in these figures which are similar to the parts of adaptor 10 retain the same reference numerals, and different or modified parts are identified by different reference numerals. FIG. 7 illustrates an adaptor 30 that is configured and dimensioned to be used on the gimbal housing of a Mercruiser Bravo drive unit. Although adaptor 10 may be used with the Bravo drive unit, adaptor 10 is not preferred because the Bravo drive unit has four splines on its water cooling orifice that cause an unacceptably high amount of water leakage around the sides of adaptor 10. Thus, adaptor 30 is used to mitigate this water leakage. Adaptor 30 is substantially similar to the structure and operation of adaptor 10, except for the smooth body member end portion 32 and gasket 31.

Body member end portion 32 is obtained by extending first portion 16*a* of body member 16 completely through first aperture 14. If first portion 16*a* is threaded through first aperture 14, then threads 20 on first portion 16*a* are removed therefrom to provide the smooth end portion 32. A gasket 31, preferably of rubber or another elastomer or polyurethane material, is then placed over end portion 32 and against second side 13*b* of support plate 13.

Adaptor 30 is secured to a gimbal housing of the Bravo drive unit in the same manner as adaptor 10 is secured to gimbal housing 11, described hereinabove in detail. Thus, gasket 31 will surround the water cooling orifice and prevent leakage therefrom.

Figure 8:
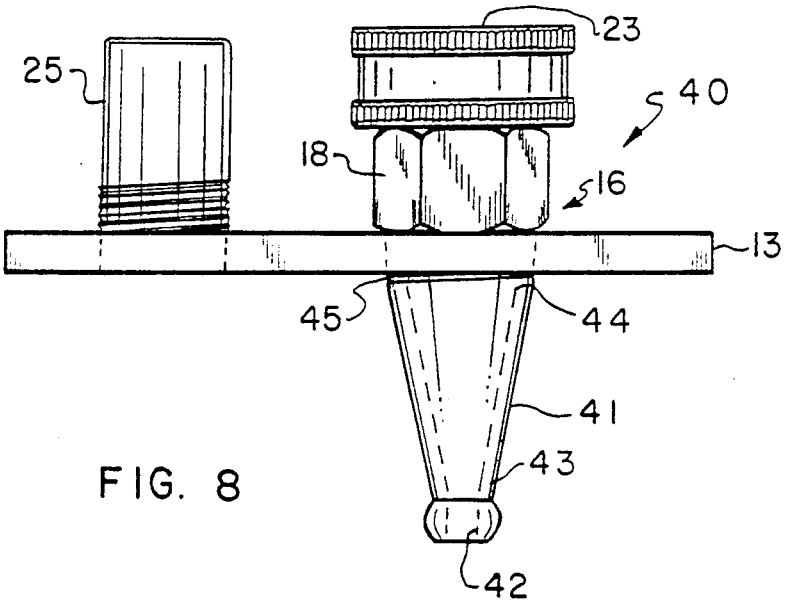
FIG. 8 is a side elevation view of another adaptor of the present invention for use with a Mercruiser Alpha or Bravo drive unit.

FIG. 8 illustrates another adaptor 40 of the present invention. Adaptor 40 may be used on the gimbal housing of either Alpha or Bravo drive units. Adaptor 40 is substantially similar in structure and operation to adaptor 10, described hereinabove in detail, except for the addition of tapered body member 41.

Tapered body member 41 comprises a central bore 42, a narrow end portion 43 and wide end portion 44. Preferably, wide end portion 44 has a threaded upper portion 45 thereon, with threads 45 engaged with lower threads 20*a* in first aperture 14 while first portion 16*a* of body member 16 is partially threaded with upper threads 20*b*. Thus, tapered body member 41 is selectively removable from adaptor 40, with central bore 42 in alignment with first aperture 14. If desired, a gasket similar to gasket 31 of FIG. 7 can be used with tapered body member 41 to prevent water leakage when the adaptor is connected to certain gimbal housings. It is also contemplated that threads 45 may be omitted and that tapered body member 41 be attached to either second side 13*b* or to edge 14*a* of first aperture 14 by welding, brazing, soldering or by use of a suitable adhesive, such as an epoxy, as noted above in FIGS. 5 and 6. It is also contemplated by the present invention that tapered body member 41 may be formed integrally with body member 16. Thus, central bore 17 of body member 16 would extend from second portion 16*b* of body member 16 to narrow end portion 43.

Adaptor 40 is secured to a gimbal housing of an Alpha or Bravo drive unit in the same manner as adaptor 10 is secured to gimbal housing 11, described hereinabove in detail. However, when nut 29 is tightened onto stud 28*a* (see FIG. 1), the tapered body member 41 will be wedged into cooling orifice 22, thereby providing a superior seal around cooling orifice 22. Thus, little or no water will leak out from cooling orifice 22.

Figure 9:
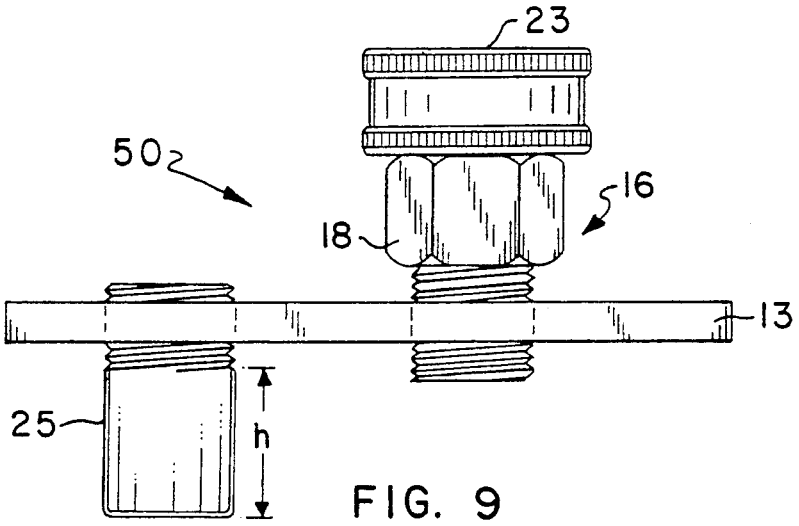
FIG. 9 is a side elevation view of an adaptor of the present invention for use with a OMC Cobra drive unit.
Figure 10:
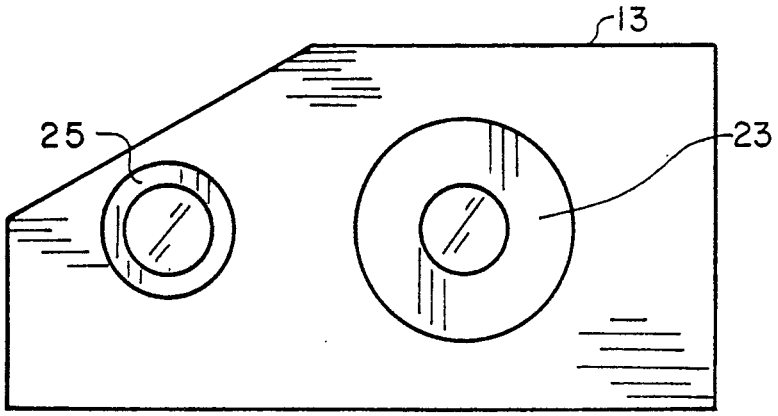
FIG. 10 is a plan view of the adaptor of FIG. 9.

Yet another embodiment of the present invention is illustrated in FIGS. 9 and 10. FIGS. 9 and 10 illustrate an adaptor 50 that is configured and dimensioned to be used on a gimbal housing for an OMC Cobra drive unit. The gimbal housing on a Cobra drive unit differs from the Alpha and Bravo drive units in that the stud closest the cooling orifice is recessed in the gimbal housing, and the shape of the gimbal housing itself is different.

To compensate for these differences, and in order to maintain support plate 13 flush against the gimbal housing, spacer 25 is positioned on the opposite side of support plate 13 from which body member 16 is attached. Further, to compensate for slight dimensional differences between various gimbal housings, the height H of the spacer 25 extending for the support plate of adaptor 50 is adjustable by rotation of spacer 25 on threads 21. Further, as shown in FIG. 10, the shape of support plate 13 is modified to compensate for the different shape of the gimbal housing on a Cobra drive unit. In all other respects, the structure and operation of adaptor 50 is similar to the structure and operation of adaptor 10, and the modifications to adaptor 10 discussed in connection with adapters 20, 30, and 40 are equally applicable to adaptor 50.

As noted above, the various adaptors of the invention may be fabricated from metal with the plate preferably made of aluminum and the connectors made of brass. It is also contemplated that the adaptor could be made of either thermosetting plastics or thermoplastics either as a single molded part or in multiple portions which are attached by an adhesive or, when thermoplastics are used, by ultrasonic welding.

Accordingly to the provisions of the Patent Statutes, I have explained the principle, preferred construction and mode of operation of my invention and have illustrated and described what I now consider to represent its best embodiments. However, it should be understood, that within the scope of the appended claims, the invention may be practiced otherwise than as specifically illustrated and described.

I claim:

1. An adaptor for directing water into a stern drive engine having an outdrive and a gimbal housing with a cooling orifice therein which allows water to pass through and cool the engine during operation thereof, said adaptor attachable to the gimbal housing after the outdrive has been removed from the stern drive engine and comprising:

a support plate having first and second sides, and at least a first aperture extending therethrough;

a body member having first and second end portions and a central bore with the first end portion connected to the support plate so that the central bore of the body member is in fluid association with the first support plate aperture;

means for connecting a fluid conduit to the second end portion of the body member; and means to facilitate connection of the support plate to the gimbal housing with the first aperture in fluid communication with the cooling orifice;

wherein water which passes through the fluid conduit also passes through the body member central bore, the first aperture of the support plate, the cooling orifice and into the engine for cooling or flushing thereof.

2. The adaptor of claim 1, wherein the first end portion of the body member is threadedly engaged to the first aperture of the support plate.

3. The adaptor of claim 1, wherein the end portion is connected to the support plate by one of an adhesive, welding, brazing or soldering.

4. The adaptor of claim 1, wherein the first end portion of the body member extends into at least a portion of the support plate aperture.

5. The adaptor of claim 4 wherein the first end portion of the body member extends to the second side of the support plate.

6. The adaptor of claim 1, wherein the first end portion of the body member extends and past the second side of the support plate.

7. The adaptor of claim 6, which further comprises a gasket operatively associated with the first end portion of the body member to facilitate connection to the cooling orifice of the engine.

8. The adaptor of claim 6, wherein the first end portion of the body member is tapered to facilitate connection to the cooling orifice of the engine.

9. The adaptor of claim 1, wherein the tapered first end portion of the body member has a circumference which decreases in size as the first end portion extends away from the second side of the support plate.

10. The adaptor of claim 9, which further comprises a gasket operatively associated with the tapered first end portion of the body member to facilitate connection to the cooling orifice of the engine.

11. The adaptor of claim 1, wherein the support plate connecting means comprises a second aperture in the support plate for surrounding a stud extending from the gimbal housing of the engine near the cooling orifice, a spacer having a central bore in alignment with the second support plate aperture to allow passage of the stud therethrough, so that means for engaging the end of the stud may be used to retain the spacer and support plate adjacent the engine cooling orifice with the first aperture in fluid communication therewith.

12. The adaptor of claim 11, wherein the spacer is attached to the support plate and extends from the second side of the support plate toward the engine.

13. The adaptor of claim 11, wherein the spacer is attached to the support plate and extends from the first side of the support plate away from the engine.

14. The adaptor of claim 11, wherein the spacer is attached to the support plate by one of an adhesive, welding, brazing or soldering.

15. The adaptor of claim 11, wherein the spacer is threadedly engaged with the second aperture of the support plate.

16. The adaptor of claim 11, which further comprises means for adjusting length the length of the spacer extending from the support plate.

17. A combination comprising a stern drive engine having an outdrive and a gimbal housing with a cooling orifice therein which allows water to pass through and cool the engine during operation thereof and the adaptor to claim 1 attached to the gimbal housing of the engine when the outdrive is removed so that the first aperture of the adaptor is in fluid communication with the cooling orifice.

18. The combination of claim 17 further comprising means for retaining the support plate adjacent the cooling orifice with the first aperture in fluid communication therewith.

19. The combination of claim 18 wherein the retaining means comprises a second aperture in the support plate and a spacer having a central bore in alignment with the second aperture.

20. The combination of claim 19 wherein the retaining means includes a stud extending from the gimbal housing and through the second apertures and spacer central bore, and a nut for engaging the stud.

* * * * *